United States Patent [19]

Oberstrass

[11] Patent Number: 4,559,775

[45] Date of Patent: Dec. 24, 1985

[54] FRICTION YARN FALSE TWISTING APPARATUS

[75] Inventor: Detlev Oberstrass, Tönisheide, Fed. Rep. of Germany

[73] Assignee: Barmag Barmer Maschinenfabrik AG, Remscheid, Fed. Rep. of Germany

[21] Appl. No.: 459,992

[22] Filed: Jan. 21, 1983

Related U.S. Application Data

[63] Continuation-in-part of Ser. No. 272,940, Jun. 12, 1981, Pat. No. 4,372,106, and a continuation-in-part of Ser. No. 273,076, Jun. 12, 1981, Pat. No. 4,389,841, and a continuation-in-part of Ser. No. 429,796, Sep. 30, 1982, Pat. No. 4,486,762.

[30] Foreign Application Priority Data

| | | | |
|---|---|---|---|
| Jun. 14, 1980 | [DE] | Fed. Rep. of Germany | 3022421 |
| Jul. 9, 1980 | [DE] | Fed. Rep. of Germany | 3025921 |
| Dec. 23, 1980 | [DE] | Fed. Rep. of Germany | 3048615 |
| Jun. 5, 1982 | [DE] | Fed. Rep. of Germany | 3221352 |
| Jul. 24, 1982 | [DE] | Fed. Rep. of Germany | 3227711 |
| Sep. 10, 1982 | [DE] | Fed. Rep. of Germany | 3233624 |

[51] Int. Cl.[4] ..... D02G 1/08

[52] U.S. Cl. ..... 57/340; 57/88; 57/105; 57/339; 57/348; 474/117; 474/118

[58] Field of Search ..... 57/334–340, 57/348, 349, 88, 89, 104, 105; 474/113, 117, 118

[56] References Cited

U.S. PATENT DOCUMENTS

| | | | |
|---|---|---|---|
| 4,060,967 | 12/1977 | Lorenz | 57/104 X |
| 4,145,871 | 3/1979 | Iwata et al. | 57/340 |
| 4,370,852 | 2/1983 | Oberstrass et al. | 57/340 |
| 4,372,106 | 2/1983 | Oberstrass | 57/334 |

*Primary Examiner*—John Petrakes

*Attorney, Agent, or Firm*—Bell, Seltzer, Park & Gibson

[57] ABSTRACT

A yarn false twisting apparatus is disclosed which comprises a pair of rotating circular discs having cooperating friction surfaces for engaging a running yarn at a twisting zone. A pressure applying member is positioned to apply a biasing force to the rear surface of one of the discs locally at the twisting zone, and the pressure applying member comprises a receptacle slideably mounting a piston which extends from the end of the receptacle to engage the disc. The receptacle is eccentrically mounted to permit selective positioning of the biasing force with respect to the yarn path of travel. The discs are mounted on pivotal rocking arms whereby the ratio of yarn twist to yarn speed may be adjusted, and an eccentrically mounted pin provides closely controlled adjustability for the arms and thus the twist ratio. The apparatus may be readily configured to provide either S or Z twist, and the drive system may be disengaged while in either the S or Z twist configuration to terminate rotation of the discs and thereby facilitate yarn thread-up.

10 Claims, 17 Drawing Figures

FRICTION YARN FALSE TWISTING APPARATUS

This is a continuation-in-part of copending U.S. applications, Ser. No. 272,940 filed June 12, 1981, now U.S. Pat. No. 4,372,106; Ser. No. 273,076 filed June 12, 1981, now U.S. Pat. No. 4,389,841; and Ser. No. 429,796 filed Sept. 30, 1982, now U.S. Pat. No. 4,486,762.

The present invention broadly relates to a yarn false twisting machine of the type disclosed in the U.S. patent to Kubler, U.S. Pat. No. Re. 30,159, and more particularly, to the structure of the yarn twisting apparatus of such machine.

As illustrated for example in the above noted Kubler patent, a yarn false twisting machine is designed to subject each of a plurality of running yarns to simultaneous twisting, heat setting, cooling, and untwisting operations, which result in the twist being permanently set into the yarn. Each twisting apparatus of the machine includes rotating twist imparting members having cooperating friction surfaces, and the advancing yarn is guided between the cooperating friction surfaces of the rotating members, whereby the desired twist is imparted to the yarn. The twist imparting members may, for example, comprise a pair of rotating discs as described in U.S. Pat. No. 4,339,915, or a pair of rotating belts as described in U.S. patent application Ser. No. 219,329, now U.S. Pat. No. 4,377,932. In these latter examples, a pressure applying member is also provided which is positioned to bias one twist imparting member toward the other member locally at the twisting zone.

The three above identified parent applications each disclose a drive arrangement for operatively rotating the twist imparting members. Specifically, the illustrated drive apparatus includes a drive whorl rotatably mounted in a whorl support member, means mounting the whorl support member to the frame so that the drive whorl is adapted to be tangentially engaged and rotated by a main drive belt of the apparatus, a drive pulley operatively connected to the drive whorl for concurrent rotation therewith, a belt pulley operatively connected to each of the twist imparting members, an idler pulley mounted to the frame, and a drive belt interconnecting the drive pulley, the two belt pulleys, and the idler pulley.

It is an object of the present invention to provide a yarn false twisting apparatus of the described type which includes a pressure applying member which is adapted to effectively apply a biasing force to the adjacent rotating twist imparting member, and which includes provision for accurately adjusting the location of the applied force.

It is another object of the present invention to provide a yarn false twisting apparatus of the described type which has the ability to accurately adjust the ratio of yarn twist to yarn advance speed.

It is still another object of the present invention to provide a yarn false twisting apparatus of the described type which may be readily converted to produce either S twist or Z twist, and which further includes provision for selectively disengaging the rotation of the twist imparting members while in either the S twist or the Z twist configuration.

It is a further object of the present invention to provide a yarn false twisting apparatus of the described type and which includes yarn guide means for effectively facilitating the yarn thread-up of the apparatus.

These and other objects and advantageous of the present invention are achieved in the embodiment illustrated herein by the provision of a yarn false twisting apparatus which includes means for applying a biasing force to an adjacent rotating twist imparting member, and which comprises a mounting receptacle, and a piston slideably disposed in the receptacle and extending axially from the receptacle to define a free piston end. The free end includes a recess formed in a portion thereof, and a retainer is fixed to the receptacle and includes a lateral tongue disposed in the recess and overlying the shoulder to thereby limit the outward axial movement of the piston from the receptacle. Thus removal of the piston from the receptacle is prevented. Also, the tongue has a thickness less than the depth of the recess whereby the free end of the piston is adapted to extend axially beyond the tongue so as to prevent contact between the tongue and the adjacent member.

A passageway preferably extends through both the receptacle and piston, and the passageway is connected to a source of pressurized air, whereby the air acts to bias the piston forwardly into contact with the adjacent twist imparting member, as well as providing a lubricating airstream between the free end of the piston and the member. Also, the receptacle is eccentrically mounted, to permit lateral adjustment of the piston, and thus the center of the biasing force, by rotational movement of the receptacle.

In the illustrated embodiment, the twist imparting members comprise circular discs which are rotatably mounted to respective rocking arms, with the rocking arms being pivotally mounted for movement about a common central axis which is coincident to the twisting zone. Thus the discs may be selectively moved about the central axis to vary the ratio of yarn twist to the yarn advance speed.

To provide accurate adjustment of the pivotal positioning of the rocking arms, and thus the twist ratio, there is provided an arcuate edge surface along each rocking arm, and a plurality of teeth are formed along the edge surface. A pin is mounted to the frame of the apparatus for selective positioning between the adjacent teeth, and preferably, the pin is eccentrically mounted to permit lateral movement and thus adjustment of the pivotal position of the arm in increments less than the spacing between adjacent teeth.

The yarn false twisting apparatus of the present invention may be readily converted between two configurations, for applying either S twist or Z twist to the yarn. This objective is achieved by a drive system which includes a drive whorl, and means for mounting the drive whorl on either side of the drive belt to thereby permit reversal of its direction of rotation. Also, the rocking arms which mount the discs may be pivoted between two positions wherein the discs are located on respective opposite sides of the twisting zone and the yarn path of travel. Thus by reversing the direction of rotation of the discs, and reversing the relative positions of the discs, the apparatus may be converted from S to Z twist, and vice versa. The drive whorl is also mounted to a pivotal control arm, which permits the drive whorl to be selectively withdrawn from contact with the drive belt in either the S twist or Z twist configuration, to thereby terminate rotation of the discs.

Some of the objects having been stated, other objects and advantages of the present invention will become apparent as the description proceeds, when taken in connection with the accompanying drawings in which.

Figure 7:
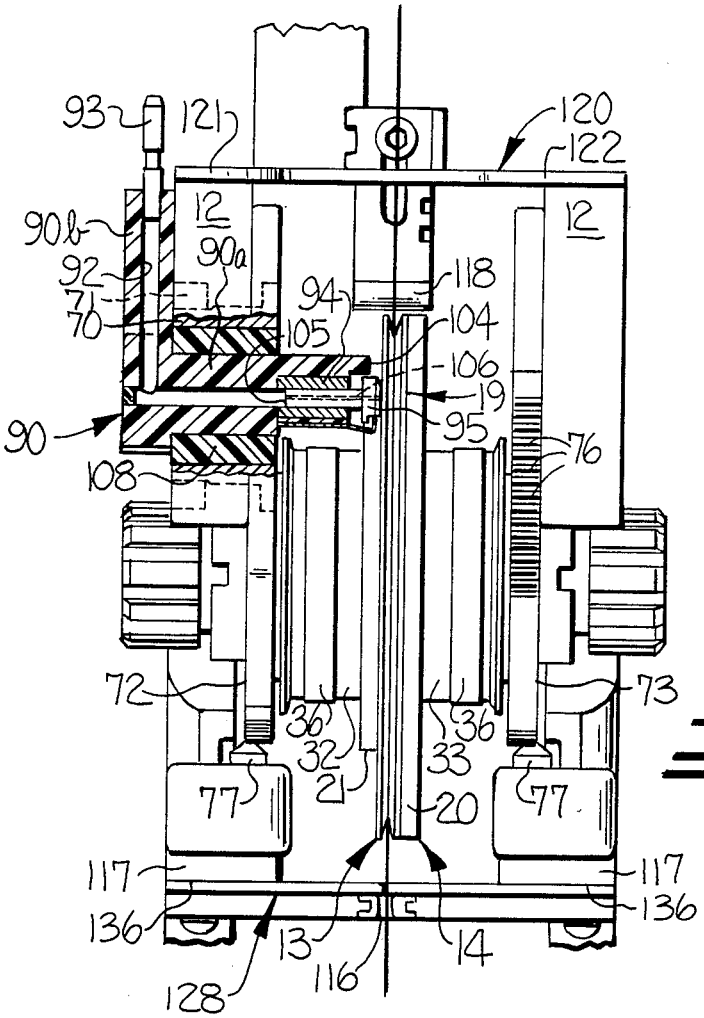
FIG. 7 is a fragmentary front plan view of the apparatus.

Referring more particularly to the specific embodiment of the invention illustrated in the drawings, there is disclosed a yarn false twisting apparatus 10 which comprises a frame 12 which operatively mounts a pair of twist imparting members in the form of circular discs 13 and 14. The discs 13 and 14 are each relatively thin and flexible, and each includes a yarn engaging friction surface on one face thereof. The discs are rotatably mounted on generally parallel shafts 16 and 17, respectively, and such that the friction surfaces are disposed in opposing relationship and define a twisting zone at 19 therebetween. As best seen in FIG. 7, a rigid circular back-up plate 20 is mounted on the shaft 17 and is disposed to overlie the full area of the opposite or outer side of the disc 14, and a back-up plate 21 of smaller diameter is mounted on the shaft 16 and disposed to overlie the opposite or outer side of the disc 13. The diameter of the plate 21 is such as to not overlie the twisting zone 19.

The discs 13 and 14 are rotated by a drive system which includes a drive component 24 composed of a unitary drive member 25 which defines a drive whorl 26 and a coaxial drive pulley 27. The drive member 25 is rotatably mounted in a whorl support bracket 28, which is movably mounted to the frame of the apparatus in the manner set forth below, and the drive whorl 26 is positioned for engagement by the tangential drive belt 30, which effects rotation thereof. The drive system further includes a belt pulley 32, 33 coaxially connected to each disc 13 and 14 respectively, and an idler pulley 34 fixed to the frame. An endless belt 36 operatively interconnects the drive pulley 27, the two belt pulleys 32, 33, and the idler pulley 34 for effecting concurrent rotation thereof with rotation of the drive whorl 26.

The apparatus is constructed to permit it to be configured in each of two operating configurations. In a first configuration, the whorl 26 is positioned on one side of the drive belt 30 to rotate the discs 13 and 14 in a first rotational direction which imparts S twist to the yarn (note FIGS. 3 and 4). In the second configuration, the whorl 26 is positioned on the other side of the drive belt to rotate the discs in the opposite direction which imparts Z twist to the yarn (note FIGS. 5 and 6). In addition, the drive component 24 and the support bracket 28 are mounted to the frame of the apparatus by a structure which permits the drive whorl to be maintained in either an operating position or an inoperative position, while in each configuration.

The mounting means for the drive component 24 and support bracket 28 includes a rod 38 slideably mounted to the frame 12 for movement along a direction perpendicular to the rotational axis of the drive whorl. A transverse pin 39 is fixed to the rod and extends through an oversized aperture 40 in the bracket 28, whereby axial movement of the rod 38 serves to correspondingly move the support bracket 28 and thus the drive component. A leaf spring 42, in the form of parallel spring plates, interconnects the support bracket 28 to the frame 12, while permitting limited movement in a direction perpendicular to the rotational axis of the drive component. A clip 44 is provided which includes a lateral slot which permits the clip to be removably mounted on the rod in one of two grooves **45*a*, 45*b*, and a spring 46** is positioned between the clip and the frame of the apparatus.

Figure 2:
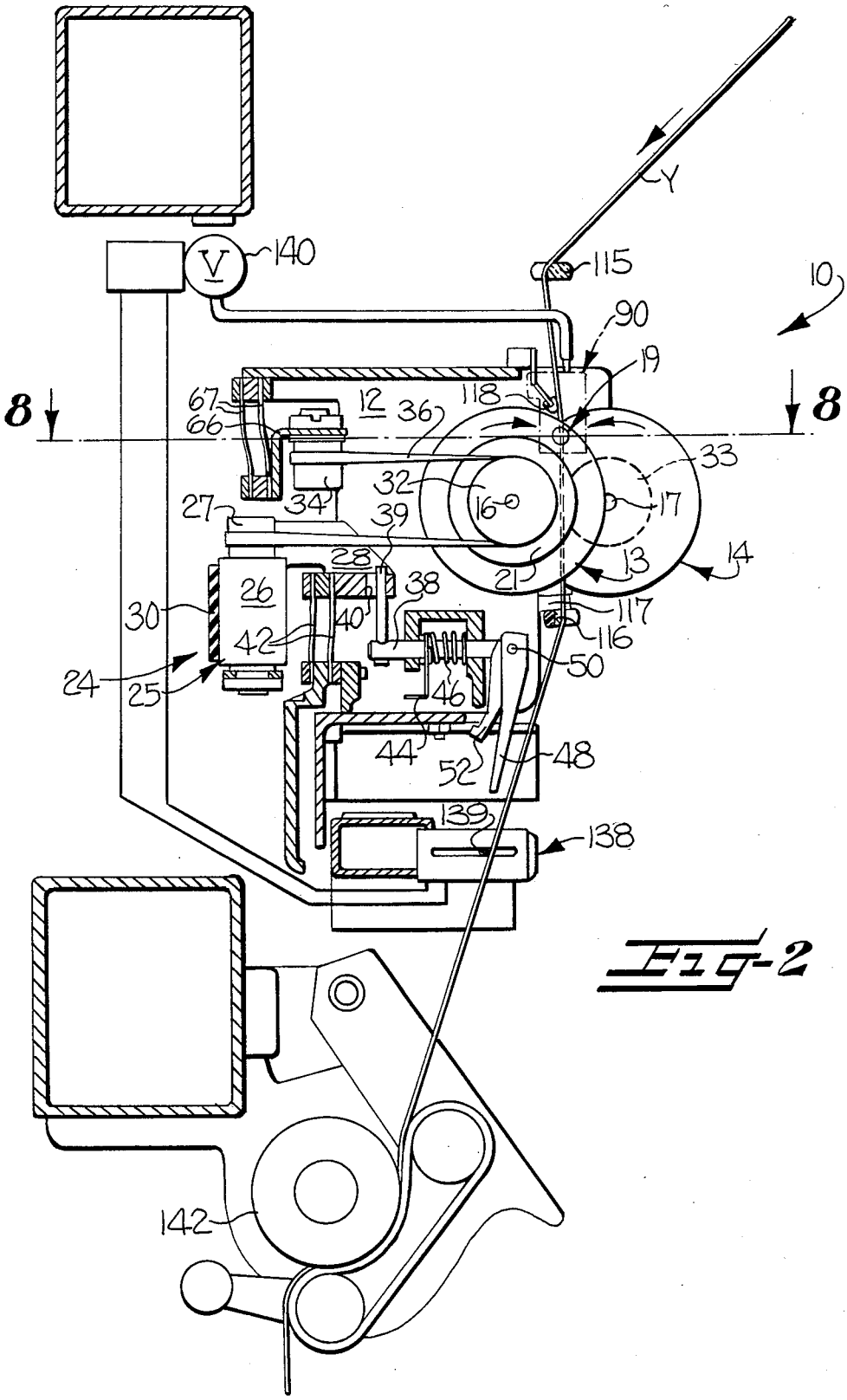
FIG. 2 is a sectional side elevation view of the apparatus, and taken substantially along the line 2—2 of FIG. 1.
Figure 3:
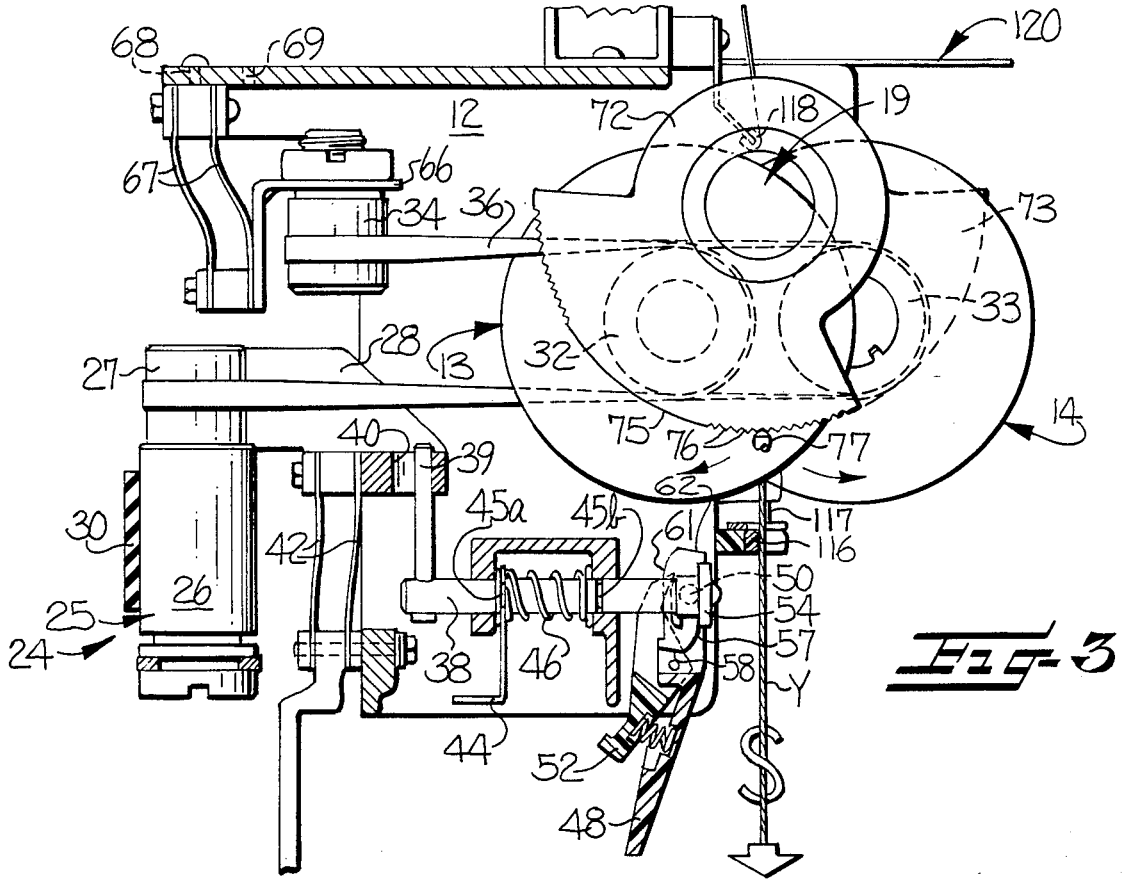
FIG. 3 is a fragmentary view similar to FIG. 2, and illustrating the apparatus in the S-twist configuration and in the operative position of the drive system.
Figure 4:
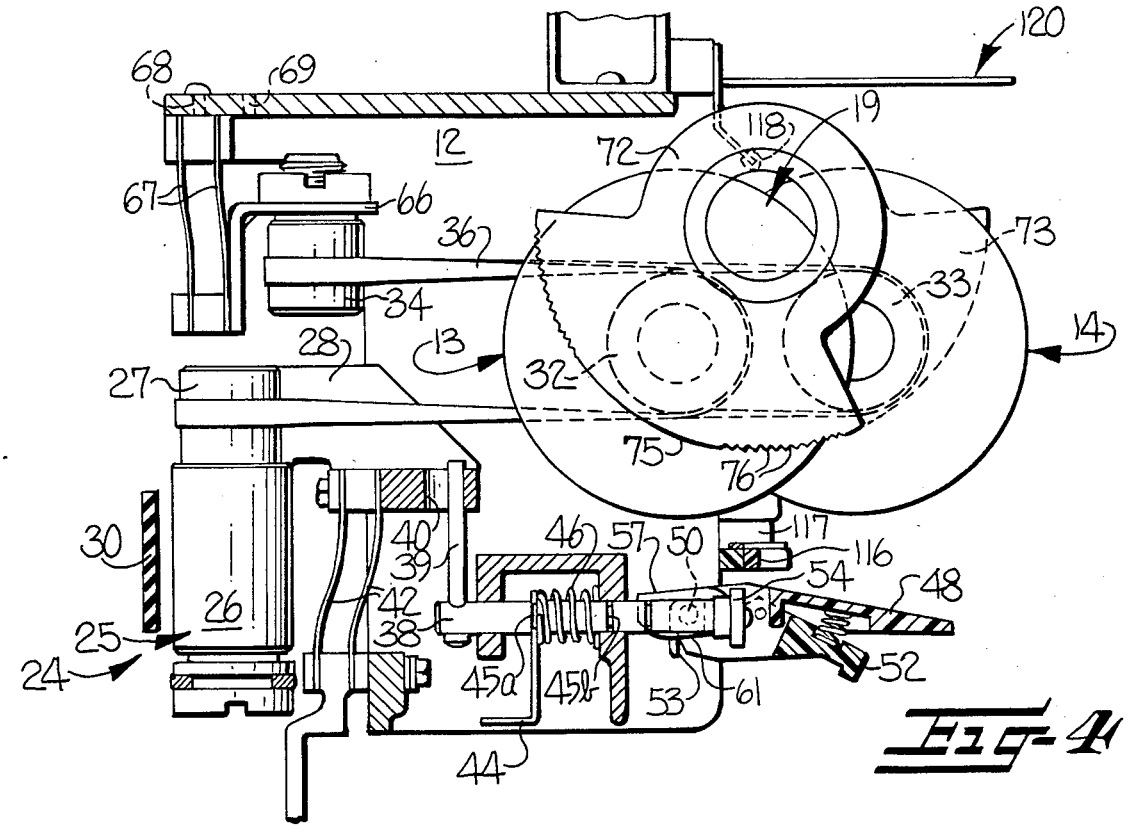
FIG. 4 is a view similar to FIG. 3 but illustrating the drive system in its inoperative position.

In the configuration of FIGS. 2–4, which is designed to impart S twist to the running yarn Y, the clip 44 is disposed in the groove **45*a*, and the rod 38 is biased by a spring 46 toward the left so as to bias the whorl 26 against the belt 30**, which contacts the left side of the whorl as seen in these figures.

Figure 15:
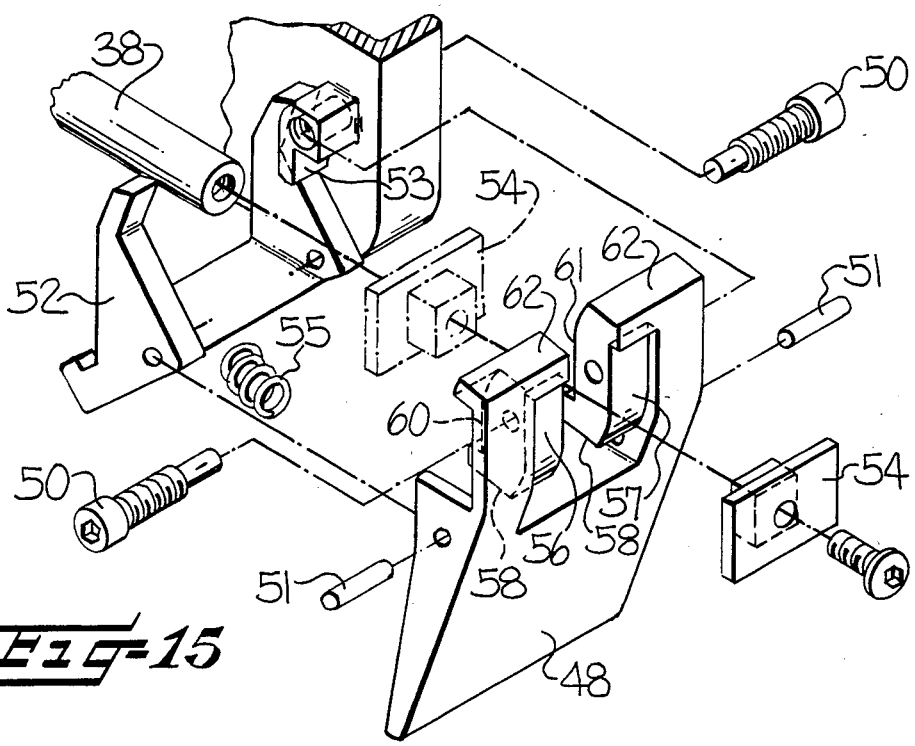
FIG. 15 is an exploded perspective view of the control arm of the apparatus.
Figure 16:
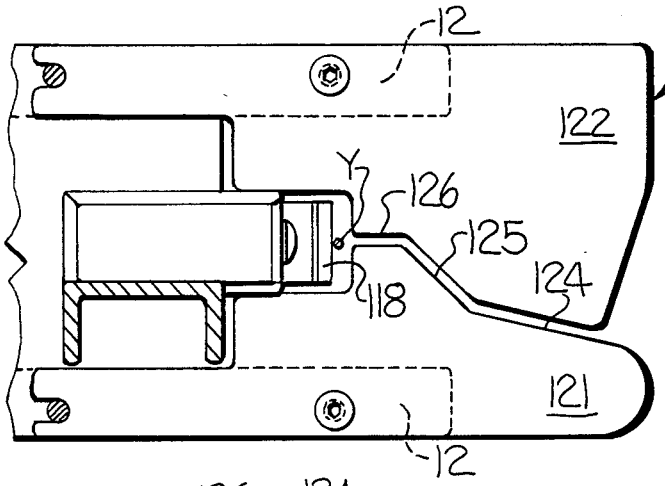
FIG. 16 is a plan view of the upper guide plate of the apparatus.
Figure 17:
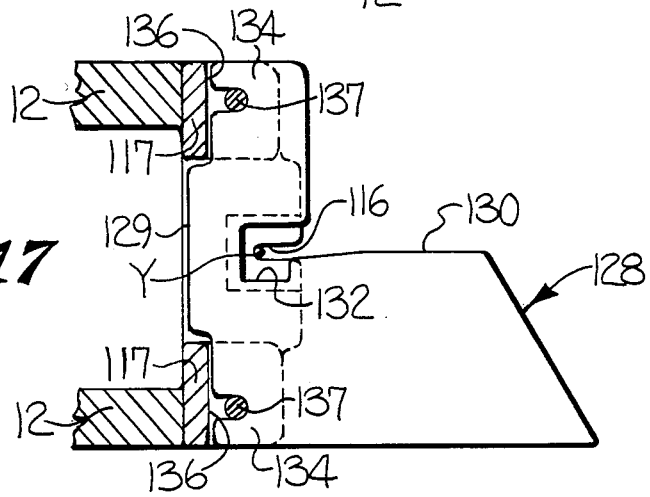
FIG. 17 is a plan view of the lower guide plate and mounting bracket.

A control arm 48 is operatively connected to the rod 38, and thus the drive whorl 26, to permit the machine operator to selectively move the whorl between its operative and inoperative positions. As best seen in FIG. 15, the arm is pivotally mounted to the frame by a pair of coaxial pins 50. Also, the arm pivotally mounts a spring biased release lever 52 on the rear side thereof for engaging an abutment 53 on the frame as further described below. More particularly, the lever 52 is pivotally mounted to the arm 48 by the pins 51, and the spring 55 acts to bias the lever for clockwise rotation about the pins 51 as seen in FIGS. 2–5. The rod 38 includes a rectangular head 54 releaseably secured at the forward end of the rod by a threaded member, and the arm further includes a first pair of integral cam surfaces 56, 57 positioned on the front side of the arm. The cam surfaces 56, 57 each terminate in a flat 58, with the flats disposed in a plane generally perpendicular to the lengthwise extent of the arm and facing downwardly in FIG. 15. The ar also includes a second pair of cam surfaces 60, 61 on the rear side thereof, and which terminate in the upwardly directed flats 62.

In the operative position of the apparatus as shown in FIG. 3, the arm is disposed in the downward position. To move the apparatus to its inoperative position, the arm is lifted by the machine operator to the horizontal position shown in FIG. 4. During this lifting operation, the arm is pivoted about the axis of the pins 50, and the rod 38 will be drawn to the right by the engagement of the cam surfaces 56, 57 with the head 54, to thereby result in the whorl 26 being withdrawn from contact with the belt 30. In its final position as seen in FIG. 4, the flats 58 engage the rear surface of the head 54, and the release lever 52 engages the abutment 53 to maintain the horizontal position of the arm. To return the machine to its operative position, the operator releases the lever 52 from the abutment 53 by squeezing the lever and arm together, and then pressing downwardly on the arm with sufficient force to overcome the contact between the flats 58 and the head 54 of the rod, and so that the arm pivots downwardly to its original position.

Figure 5:
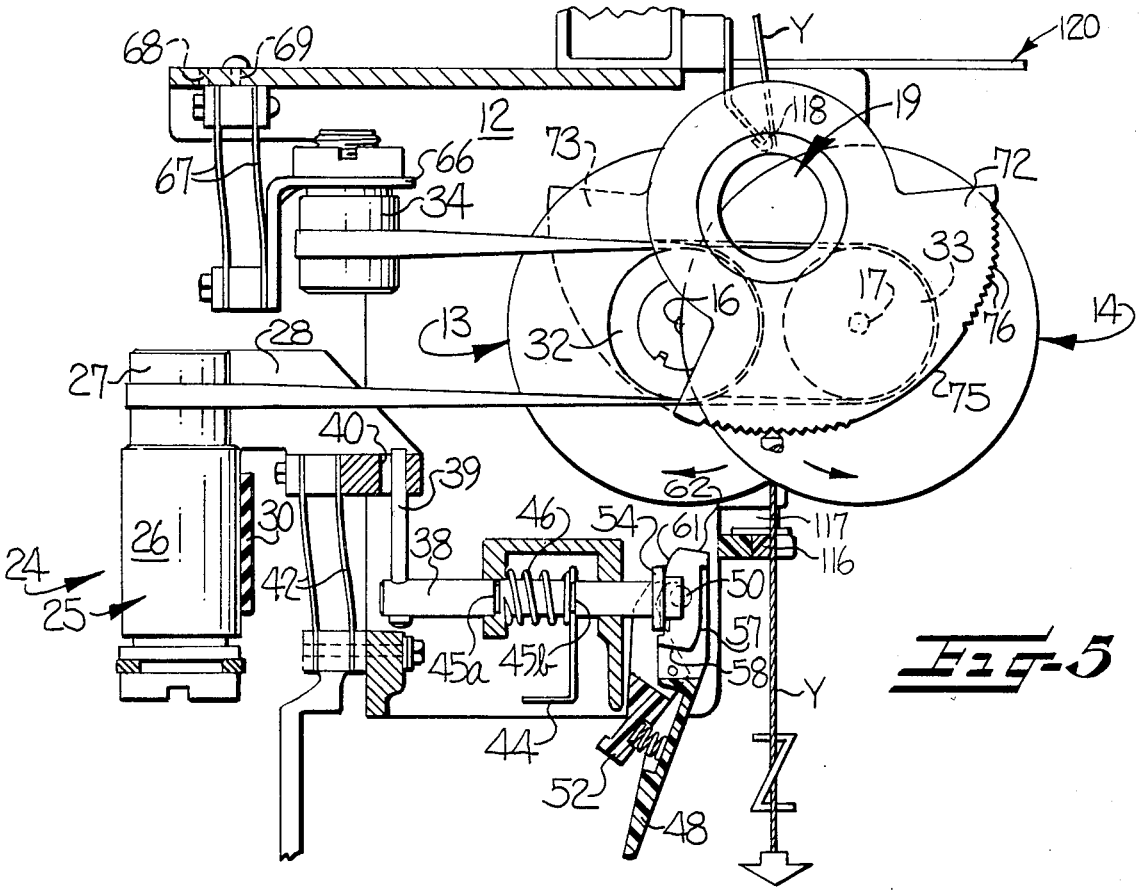
FIG. 5 is a view similar to FIG. 3, but illustrating the apparatus in the Z-twist configuration and with the drive system in the operative position.
Figure 6:
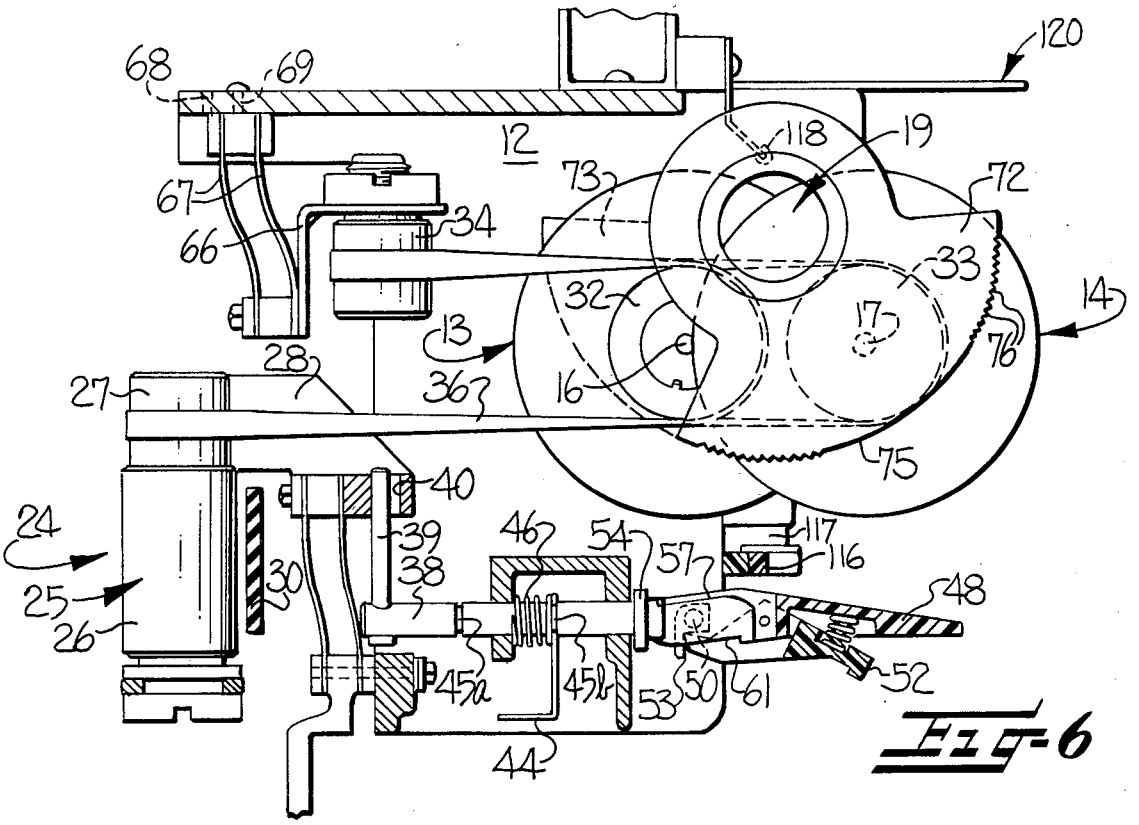
FIG. 6 is a view similar to FIG. 5 but illustrating the drive system in its inoperative position.

In the configuration of the apparatus illustrated in FIGS. 5 and 6, which is designed to impart Z twist to the yarn Y, the clip 44 is repositioned in the groove 45*b*, and the spring 46 is positioned on the opposite side of the clip 44 so as to impart a biasing force toward the right. More particularly, the clip 44 is removed from its position in the groove 45*a* and is then slipped into the groove 45*b*. Also, the interconnection between the rod and control arm is reconfigured, which includes removing the threaded member which supports the head 54 so that the head is disassembled from the rod 38. The head 54 is then reversed and positioned behind the arm so as to engage the rearwardly facing second cam surfaces 60, 61, note the dashed line position of the head 54 in FIG. 15. With the control arm in its operative position as shown in FIG. 5, the drive whorl 26 is engaged by the belt 30 on the right side of the whorl, so that the whorl and thus the discs 13 and 14 rotate in respectively opposite directions from those of the operative position of FIG. 3. Upon upward pivotal movement of the control arm 48, the head 54 slides along the cam surfaces 60, 61 until the head seats on the flats 62 and the lever 52 engages the abutment 53. The rod 38 is thereby moved to the left against the force of the spring 46, to withdraw the drive whorl 26 from contact with the belt 30. To again move the apparatus to its operative position, the lever 52 is released from the abutment 53 and the arm 48 is pivoted downwardly in the same manner as described above. Thus in each of the two configurations of the apparatus, the control arm 48 is disposed in the same downward position during operative engagement with the drive belt, and the arm is pivoted outwardly to its horizontal inoperative position to withdraw the whorl from the belt. Also, in its inoperative position, the arm will act to deflect the running yarn Y from the twisting zone 19, as further described below.

The idler pulley 34 is adapted to be rotatably mounted to the frame in one of two separate positions, with the idler pulley being rotatable about an axis generally parallel to that of the drive member 25 in each position. One of the mounting positions is utilized in the S-twist configuration of the apparatus, and the other position is utilized in the Z-twist configuration. By this arrangement, the idler pulley is able to accommodate for any movement of the drive whorl when the apparatus is changed from S to Z twist or vice versa, and thereby maintain the desired tension in the endless belt 36.

The mounting means for the idler pulley 34 includes a bracket 66 rotatably mounting the idler pulley 34, with the bracket including a leaf spring 67 in the form of two parallel spring plates. Also, two pairs of apertures 68, 69 are positioned in the frame for selectively receiving the mounting bolts for the bracket, and such that the bracket may be mounted to either pair of apertures.

Figure 8:
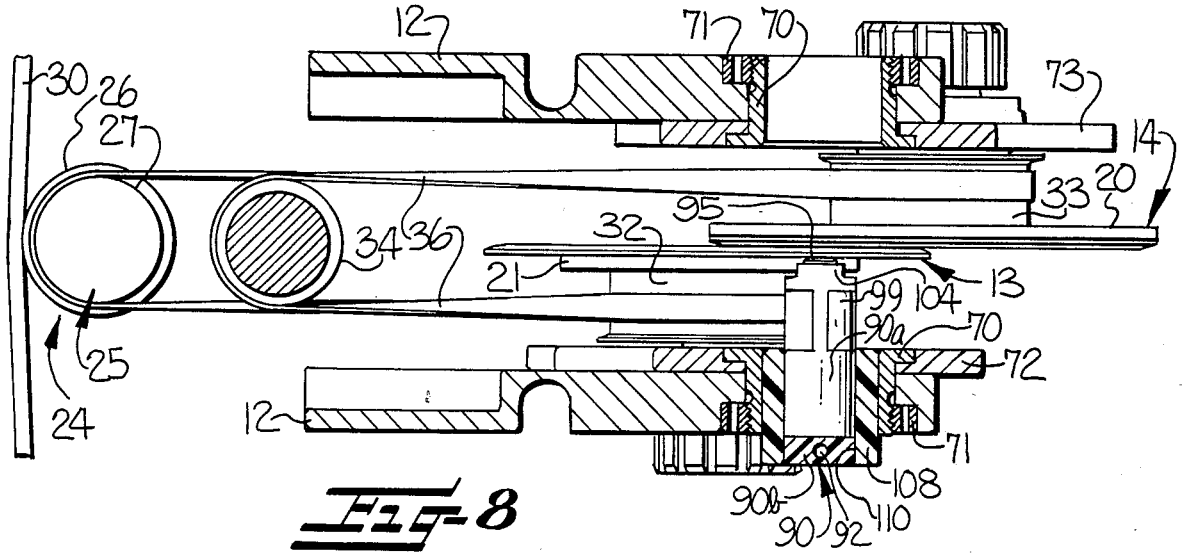
FIG. 8 is a sectional plan view taken substantially along the line 8—8 of FIG. 2.

As noted above, the discs 13 and 14 are mounted to the frame for rotation about parallel spaced apart axes. These spaced apart axes are parallel to a central axis which is coincident to the twisting zone 19. The disc mounting means includes a pair of rocking arms 72, 73 pivotally mounted to the frame of the apparatus for selective pivotal movement about the central axis. Specifically, the arms each include a threaded sleeve 70 fixed thereto, which is secured to an aperture in the frame 12 by a nut 71 as best seen in FIG. 8, and with the sleeves 70 being coaxially disposed about the central axis. The discs are rotatably mounted to respective ones of the rocking arms by means of the shafts 16 and 17 which are fixed to the discs and extend along the axes of rotation. The rocking arms 72, 73 and thus the discs may be selectively moved about the central axis to vary the ratio of the yarn twist to the yarn advance speed. Also, the discs may be moved between two relative positions to permit conversion from S to Z twist, and vice versa, in the manner further described below.

Figure 9:
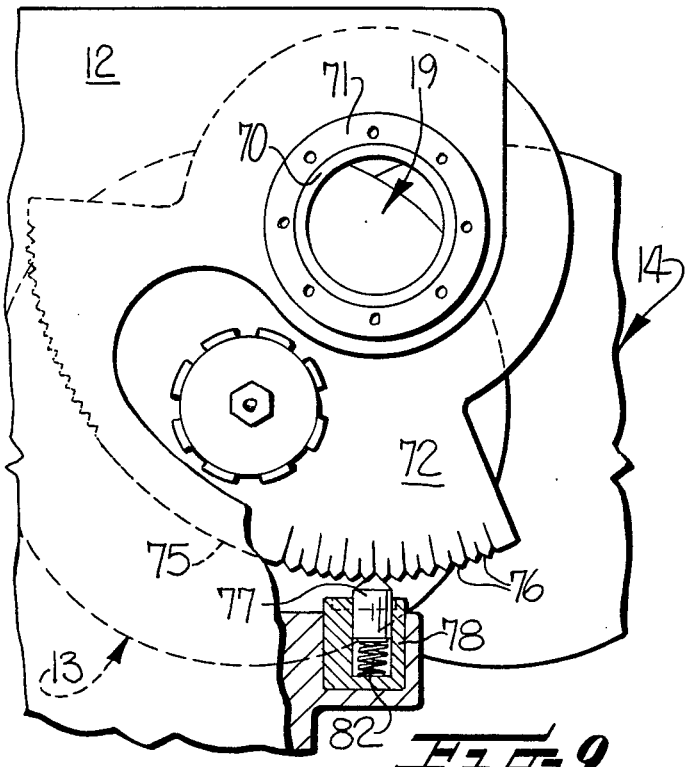
FIG. 9 is a fragmentary view of a portion of a rocking arm and its associated locating pin.

In order to permit accurate adjustment of the pivotal positioning of the rocking arms 72, 73, each arm is provided with an edge surface 75 which is curved along the arc of a circle having its center coincident with the central axis at 19. A plurality of V-shaped teeth 76 are formed along each edge surface as best seen in FIG. 9, and a locating pin 77 is mounted to the frame in association with each edge surface, for selective positioning between any adjacent pair of teeth. By this arrangement, the pivotal position of the arm may be accurately adjusted and held at a predetermined rotational position.

Figure 10:
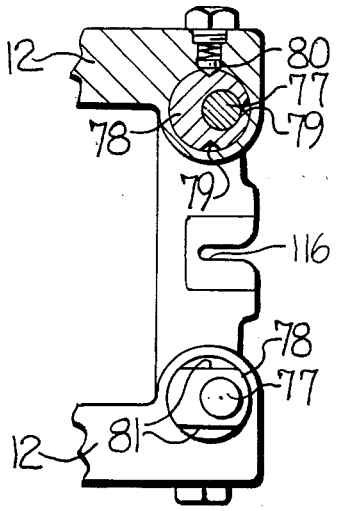
FIG. 10 is a partially sectioned plan view illustrating the mounting structure for the two locating pins of the rocking arms.

The notches formed between adjacent teeth 76 must usually have a distance of about three degrees between them in order that the notch may be of sufficient size to provide a proper seat for the pin 77. In some instances however, it is desirable that the arms and discs be adjustable in smaller increments, and for this purpose the pin 77 is mounted to the frame so as to permit lateral movement in a direction along the edge surface a selected distance which is less than the distance between adjacent teeth 76 on the edge surface. Thus, each rocking arm may be pivotally adjusted in increments less than the spacing between adjacent teeth by the lateral movement of the pin. As best seen in FIG. 10, each pin 77 is mounted by an arrangement which includes a bushing 78 having a central bore slideably mounting the pin 77 therein and defining a central bore axis. The bushing 78 is mounted to the frame for rotation about an axis disposed parallel to and laterally offset from the central bore axis, whereby rotation of the bushing effects the lateral movement of the pin. The outer periphery of the bushing includes three notches 79 spaced ninety degrees from each other, and a pin 80 is mounted to the frame and is biased by the spring 81 and screw 82 into selective engagement with each one of the notches during rotation of the bushing. Thus the bushing 78 may be held in any one of three predetermined rotational positions. Further, the end of the bushing includes exposed surfaces 83 adapted for engagement by a turning tool to facilitate the rotation thereof, and a spring 84 is disposed in the bore of the bushing beneath the pin for biasing the pin outwardly into engagement with the teeth.

Figure 11:
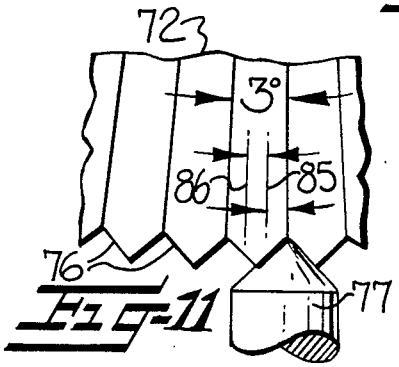
FIG. 11 is an enlarged fragmentary view illustrating the engagement between the teeth of one rocking arm and its associated retaining pin.
Figure 12:
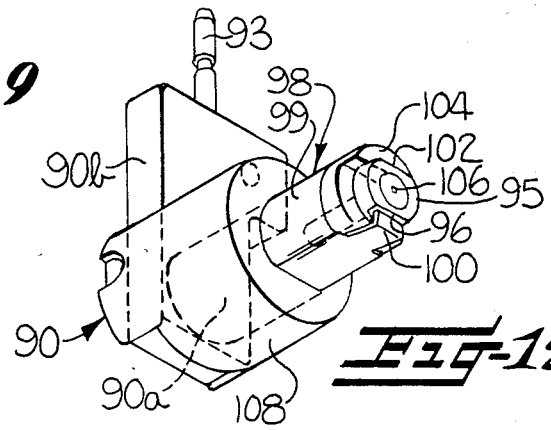
FIG. 12 is a fragmentary perspective view of the pressure applying member of the apparatus.
Figure 13:
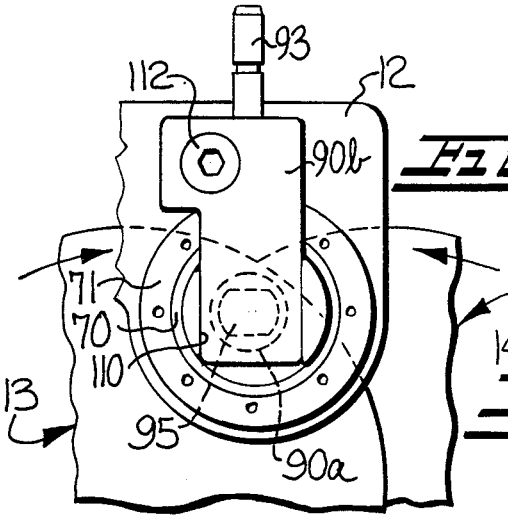
FIG. 13 is a fragmentary side elevation view of the pressure applying member in one orientation.

FIG. 11 is an enlarged fragmentary view of the edge 75 of the rocking arm and pin 77. Assuming the pin and bushing to have the position shown in upper portion of FIG. 10, it will be seen that rotation of the bushing ninety degrees counterclockwise, and until the pin 80 engages the next notch, will cause the pin to move to the left as shown in FIG. 11 to the point 85. Similarly, if the bushing is again rotated an additional ninety degrees so that the set screw engages the final notch, the pin will move further to the left to the point 86. Thus in the illustrated embodiment, the eccentricity of the bushing 78 is designed such that the movement of the pin during each ninety degrees of rotation will laterally advance the pin and rotate the arm one third of the distance between adjacent teeth 76 on the edge surface 75, and thus permits the rocking arms to be located in increments of one degree. By this arrangement, the ratio of yarn twist to yarn advance speed may be accurately and precisely adjusted and maintained.

FIGS. 7 and 12–14 illustrate the biasing means for applying a biasing force to the rotating disc at the twisting zone 19. In this regard, it will be seen that the disc 13 is readily flexible in a direction perpendicular to its friction surface and toward the disc 14. Also, the presence of the back-up plate 20 renders the disc 14 relatively rigid in resisting movement in such direction. In the illustrated embodiment, the biasing means comprises a mounting receptacle 90 composed of a generally cylindrical portion **90*a* and a lateral arm portion 90*b* at the rearward end of the cylindrical portion. A passageway 92 extends through both the arm portion and cylindrical portion of the receptacle, and the receptacle mounts a nipple 93 at the outer end of the arm in communication with the passageway. A bushing 94 is fixedly mounted in the passageway at the forward end of the receptacle, and a piston 95 is slideably mounted in the bushing 94. The piston 95 extends outwardly from the receptacle to define a free end, and the free end includes a recess 96** formed in a portion thereof, and so as to define a transverse shoulder.

A retainer 98 is mounted at the forward end of the receptacle, and it includes a clip portion 99 which surrounds and is releasably fixed to the outer periphery thereof. The retainer also includes a lateral tongue 100 which is positioned so as to be disposed in the recess 96 of the piston and overlie the shoulder 96. By this arrangement, the tongue 100 of the retainer acts to limit the outward axial movement of the piston from the receptacle, and thereby prevent the inadvertent removal of the piston therefrom. Also, the tongue 100 has a thickness less than the depth of the recess 96, whereby the free end of the piston is adapted to extend axially beyond the tongue so as to prevent contact between the tongue and the adjacent rotating disc.

The free end of the piston further includes a second recess 102 formed in the circumferential periphery thereof, with the second recess defining a laterally facing wall surface. The receptacle includes a mating integral projection 104 which is received within the recess 102 and is adapted to engage the laterally facing wall surface to preclude relative rotation therebetween. The piston also defines an end or shoulder 105 disposed within the passageway 92 of the receptacle and facing in a direction opposite the free end. Further, the piston includes a channel 106 extending axially therethrough from the shoulder 105 to the free end, for conveying pressurized air from the shoulder 105 to a location between the free end of the piston and the adjacent disc. Thus upon pressurized air being directed into the passageway, the air will act upon the shoulder to resiliently bias the piston toward the adjacent disc 13, and a portion of the air will pass through the channel 106 in the piston and will exit at a point between the free end of the piston and the disc to provide a lubricating and cooling effect.

The receptacle 90 is mounted to the frame of the apparatus by an arrangement which includes a sleeve 108 which is coaxially received in the sleeve 70, note FIG. 8. The mounting sleeve 108 has a cylindrical outer surface 109 which defines a sleeve axis which is coaxial with the above defined central axis of the apparatus. Also, the sleeve 108 includes an internal cylindrical bore which is eccentrically disposed with respect to the sleeve axis. The cylindrical portion **90*a* of the receptacle is closely received in the bore of the sleeve 108, whereby relative rotation between the receptaole 90 and sleeve 108 results in the receptacle being moved laterally with respect to the sleeve axis. The lateral arm portion 90*b* of the receptacle overlies the rearward end of the sleeve 108, and the rearward end of the sleeve 108 includes a slot 110 partially receiving the arm portion 90*b* of the receptacle, to thereby limit relative rotation therebetween to one of two relative positions disposed 180 degrees from each other. A set screw 112 serves to secure the arm portion 90*b* to the frame of the apparatus. To effect adjustment, the set screw 112 is released, the receptacle 90 is axially withdrawn, and the sleeve 108** is rotated 180 degrees.

Figure 14:
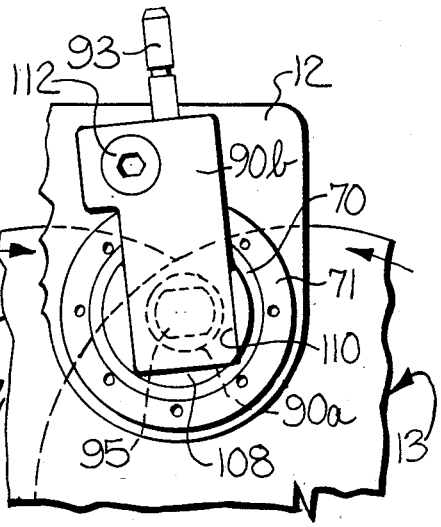
FIG. 14 is a view similar to FIG. 13 but illustrating the pressure applying member in a second orientation.

The lateral adjustment of the piston 95 is significant in that it permits the center of the free end of the piston to contact the disc 13 slightly in front of the yarn path of travel, when the apparatus is configured in either the S twist or Z twist mode. In this regard, it has been found that certain yarns produce excessive vibrations when false twisted by the illustrated apparatus, and the vibrations can affect the quality and dyeability of the resulting yarn. Such vibrations are effectively avoided by the above described asymmetric mounting of the piston. For example, in the configuration illustrated in FIG. 13, which is designed to produce S twist, the piston is positioned to the left of the yarn centerline position a distance less than about 2 mm, and preferably less than about 1 mm, to achieve the desired results. In the Z-twist configuration, the piston should be moved to the right of the yarn centerline as seen in FIG. 14.

Figure 1:
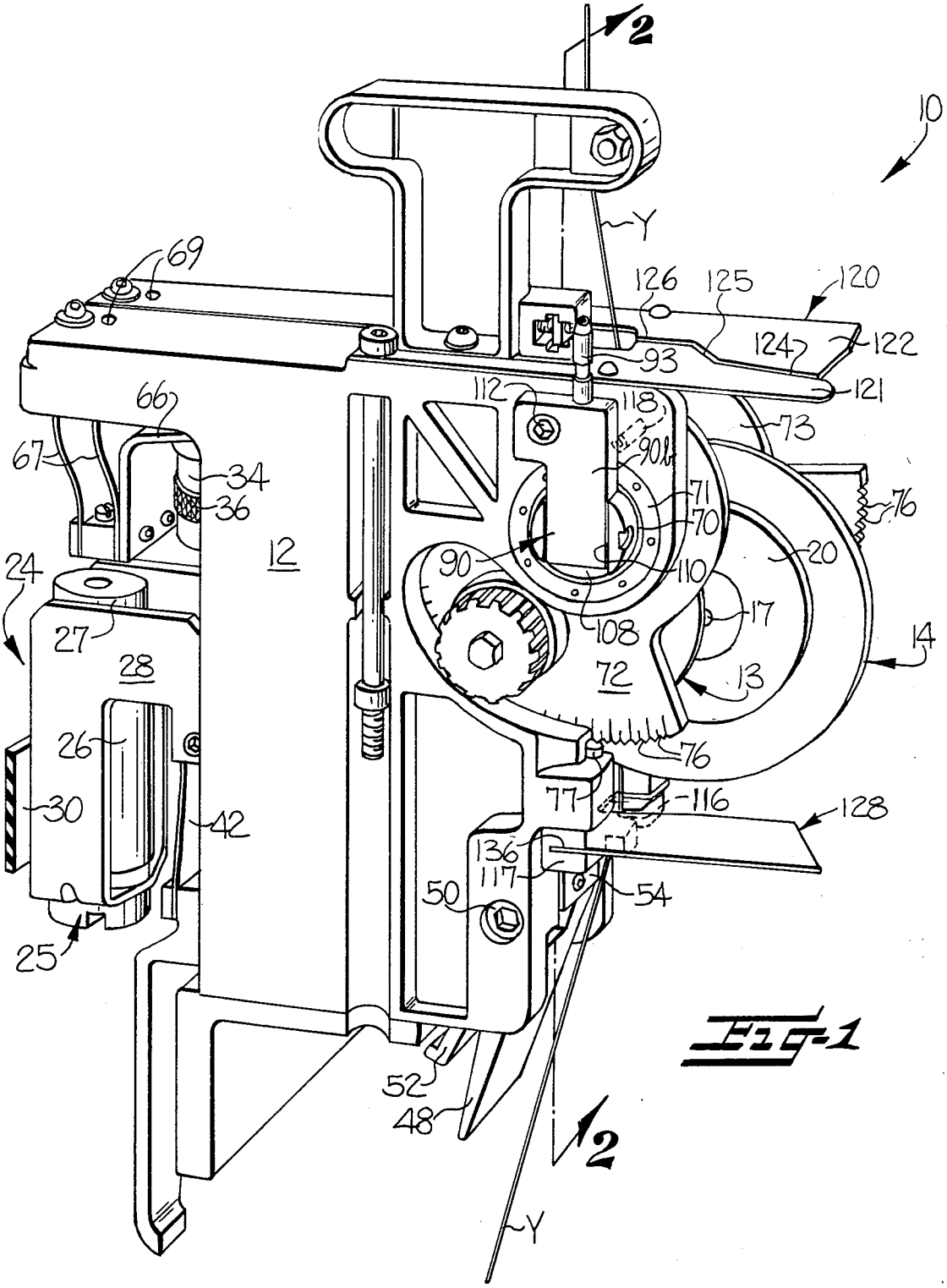
FIG. 1 is a perspective view of a yarn false twisting apparatus which embodies the features of the present invention.

The apparatus of the present invention further includes yarn guide means for guiding a running yarn Y through the twisting zone 19 and along a predetermined path on each side thereof. As best seen in FIGS. 1 and 2, the yarn guide means comprises a first U-shaped open eyelet 115 fixed on the frame upstream of the discs, and a second U-shaped open eyelet 116 fixed to a bracket 117 mounted on the opposite side of the discs. These eyelets are each aligned with the plane of the friction surfaces of the discs, and the upper eyelet 115 opens rearwardly toward the left as seen in these figures, and the eyelet 116 opens toward the right. A guide finger 118 is disposed immediately upstream of the discs and in alignment with the twisting zone.

To facilitate the yarn thread up procedure, there is further provided a thread guide 120 mounted to the frame upstream of the discs, and between the eyelet 115 and guide finger 118, for guiding a running yarn laterally into the twisting zone during the thread up procedure, and without substantial contact with the exposed rotating friction surface of the outermost disc. The thread guide 120 comprises a pair of separate segments 121, 122 of a suitable sheet metal material or the like, with the segments being disposed in a coplanar, side by side arrangement. The adjacent side edges of the two segments define a slot therebetween, with the slot having an outer portion 124 extending in a direction generally parallel to the plane of the rotating discs, a second portion 125 extending laterally at an acute angle with respect to the plane of the discs, and an inner portion 126 extending generally parallel to the first portion. Specifically, the second slot portion is disposed at an angle of about 45 degrees or less with respect to the outer slot portion 124.

The segments 121, 122 of the guide 120 are disposed in a plane perpendicular to the plane of the friction surfaces and such that the outer slot portion 124 is disposed generally parallel to and laterally offset from the plane of the friction surfaces. The inner slot portion 126 is substantially coplanar to the plane of the friction surfaces and is in substantial alignment with the twisting zone. Thus a running yarn which is guided through the slot tends to be held in spaced relation from the rotating disc, and is guided directly into the nip between the discs at the twisting zone.

The bracket 117 which mounts the U-shaped eyelet 116 also mounts a thread guide 128 downstream of the discs. The guide 128 is adapted to guide the running yarn into the eyelet 116 during the thread up procedure, and it comprises a unitary plate having a rear edge 129 and a guide surface edge 130 extending in a direction which is generally perpendicular to the rear edge 129. The guide surface edge 130 is in general alignment with the opening of the eyelet 116, and it terminates in an enlarged opening 132 adjacent and spaced from the rear edge 129. The bracket 117 includes opposite enlarged end portions 134, and coplanar slot segments 136 are disposed in each of the end portions for receiving the rear edge of the plate therein. Also, an aperture extends transversely through each of the end portions in communication with the slot segments, and a threaded member 137 extends through each aperture for releasably fixing the rear edge 129 of the guide in the slot, and for mounting the bracket 117 to the frame of the false twisting apparatus. It is noted that the thread guide 128 is open and free of any yarn guide surface edge opposite the first mentioned guide surface edge 130.

As seen in FIG. 2, a yarn sensor 138 is mounted to the frame along the yarn path of travel at a point downstream of the eyelet 116, the thread guide 128, and the control arm 48. The sensor 138 includes a finger 139 which is positioned to be contacted by the yarn when the yarn is in its predetermined path, and which is free of contact with the yarn when the yarn is deflected by the arm 48 in its horizontal inoperative position. The sensor 138 is operatively connected to a valve 140 disposed in the air supply line for the receptacle 90 of the biasing member, and such that the absence of a yarn moving along the yarn path will cause the finger 139 to move toward the right as seen in FIG. 2, which results in the valve 140 opening to release the air pressure to the receptacle 90. A conventional yarn feed roll 142 is mounted immediately downstream of the sensor.

To now describe the thread-up procedure of the illustrated apparatus, it will be understood that the running yarn Y will initially be directed into a suction tube (not shown) which is held by the machine operator in the conventional manner. In this condition, no yarn will be running between the discs, and the sensor 138 will be in a position to disconnect the air supply to the biasing piston 95. The arm 48 is lowered to its operating position so as to commence rotation of the discs, and the yarn is then hooked behind the upper eyelet 115, and threaded through the downstream feed roll 142. The yarn then falls between the thread guide 120, 128, and moves through the slot of the guide 120 and into the nip between the rotating discs at the twisting zone. As it does so, the operator preferably moves the yarn behind the finger 139 of the sensor, so that the sensor is not actuated and the air pressure remains off. The yarn is thereafter positioned through the upstream feed rolls (not shown), and the yarn is then manually moved to a position in front of the finger to actuate the biasing force of the piston 95, and such that twist is imparted to the running yarn.

To convert the apparatus from the S twist configuration as seen in FIGS. 3 and 4, to the Z twist configuration as seen in FIGS. 5 and 6, the rocking arms 72, 73 are initially rotated about the central axis so that the discs are on respectively opposite sides of the yarn path of travel and the twisting zone. The drive system is then reconfigured so that the drive belt 30 contacts the opposite side of the drive whorl 26, and thus rotates the discs in the opposite directions. The reconfiguration of the drive system involves the disassembly of the control arm 48 so that the head 54 of the rod is disposed on the inside of the arm and in contact with the inner cam surfaces 60, 61. Also, the clip 44 is removed from the groove **45*a* on the rod so that the spring may be located on the other side thereof, and the clip is replaced in the groove 45*b*. As final steps, each of the thread guides 120, 128 are turned over, and the idler pulley 34 is moved so as to be mounted in the two forward apertures 69, and such that the idler pulley is able to take up the slack in the belt 36 caused by any forward movement of the drive whorl 26. Also, the receptacle 90 of the disc biasing means is moved from the position shown in FIG. 13, to that shown in FIG. 14**. These steps are reversed to reconfigure the apparatus for Z-twist operation.

In the drawings and specification, there has been set forth a preferred embodiment of the invention, and although specific terms are employed, they are used in a generic and descriptive sense only and not for purposes of limitation.

That which is claimed is:

1. A yarn false twisting apparatus comprising a frame, a pair of twist imparting members, each having a generally flat yarn engaging friction surface, means mounting said members to said frame for rotational movement wherein portions of the respective yarn engaging friction surfaces are disposed in opposing relationship and define a twisting zone therebetween, drive means for operatively rotating each of said members, and such that a yarn may be advanced along a path of travel through said twisting zone while having twist imparted thereto, said drive means including (a) a drive whorl rotatably mounted in a whorl support member, (b) means for selectively mounted said whorl support member to said frame for operative engagement with a tangential drive belt in either a first configuration wherein the belt engages one side of the drive whorl or a second configuration wherein the belt engages the other side of the drive whorl, and so that the rotational direction of the drive whorl may be reversed, said mounting means including disengaging means for moving said whorl in a direction perpendicular to its axis in each of its two operating configurations and such that said whorl may be selectively positioned to contact said drive belt or be withdrawn from said drive belt in each of said two operating configurations, (c) a drive pulley rotatably mounted in said whorl support member and operatively connected to said drive whorl for concurrent rotation therewith, (d) a belt pulley operatively connected to each of said twist imparting members, (e) an idler pulley rotatably mounted to said frame, and (f) endless belt means operatively interconnecting said drive pulley, said two belt pulleys, and said idler pulley for effecting concurrent rotation thereof with rotation of said drive whorl.

2. The yarn false twisting apparatus as defined in claim 1 wherein said twist imparting members comprise circular discs, and said means mounting said discs to said frame includes a shaft mounted to each disc, a pair of rocking arms each rotatably mounting one of said shafts, and means mounting said rocking arms to said frame for pivotal movement about a common axis which is parallel to the axes of said shafts and passes through said twisting zone, and whereby the discs may be selectively moved about said common axis between a first relative position wherein the axes of rotation of the discs are disposed on opposite sides of said common axis and a second relative position wherein the axes are each disposed on the other side of said common axis, and the discs may be rotated in one direction while in said first relative position and in the opposite direction while in said second relative position by reversing the rotational direction of the drive whorl, to permit ready conversion between S and Z twist being imparted to the yarn.

3. The yarn false twisting apparatus as defined in claim 2 wherein one of said discs is relatively flexible, and said apparatus further comprises a pressure applying member mounted to said frame for biasing said one flexible disc toward the other disc locally at said twisting zone.

4. The yarn false twisting apparatus as defined in claim 3 further comprising means for rotatably mounting said idler pulley to said frame in one of two operative positions and for rotation about an axis generally parallel to that of said drive pulley, and so as to permit the tension in said endless belt means to be maintained upon the whorl support member being disposed in either of said operating configurations.

5. The yarn false twisting apparatus as defined in claim 1 wherein said disengaging means for said whorl includes a rod operatively connected to said support member and slideably mounted to said frame for movement along a direction perpendicular to the rotational axis of said drive whorl, and control arm means for selectively moving said rod in either axial direction.

6. The yarn false twisting apparatus as defined in claim 5 wherein said control arm means includes a control arm which is pivotally mounted to said frame, said control arm having a first cam surface adapted to engage said rod when said rod is in a first operating configuration, and a second cam surface adapted to engage said rod when said rod is in a second operating configuration, and such that the pivoting of said control arm acts to move said drive whorl between a position contacting the drive belt and a position withdrawn from the drive belt in each of said two operating configurations of said whorl support member.

7. The yarn false twisting apparatus as defined in claim 6 wherein said control arm means further includes a spring operatively connected between said rod and frame in one of two positions, and such that it may be selectively positioned to bias said rod in either direction so as to permit the rod to resiliently engage either of the first and second cam surfaces of said control arm.

8. The yarn false twisting apparatus as defined in claim 7 wherein said control arm is pivotally mounted to said frame about a fixed axis, and wherein said first and second cam surfaces are on generally opposite sides of said arm, and such that said arm is in a common first pivotal position when said drive whorl is in contact with the drive belt in each of the operating configurations of said whorl support member, and in a common second pivotal position when the whorl is withdrawn from the drive belt in each of the operating configurations of said whorl support member.

9. The yarn false twisting apparatus as defined in claim 8 wherein said apparatus further includes yarn guide means for guiding a running yarn through said twisting zone and along a predetermined path on each side thereof, and wherein said control arm lies in said path in said second pivotal position and is spaced from said path in said first pivotal position.

10. The yarn false twisting apparatus as defined in claim 1 wherein said mounting means for said whorl support member and said mounting means for said idler pulley each include a leaf spring.

* * * * *